US009982489B2

(12) United States Patent
Cox et al.

(10) Patent No.: US 9,982,489 B2
(45) **Date of Patent: *May 29, 2018**

(54) ROTATIONAL DRILL BITS AND DRILLING APPARATUSES INCLUDING THE SAME

(71) Applicant: Dover BMCS Acquisition Corporation, Orem, UT (US)

(72) Inventors: E. Sean Cox, Spanish Fork, UT (US); Russell Roy Myers, Provo, UT (US)

(73) Assignee: DOVER BMCS ACQUISITION CORPORATION, Orem, UT (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 14/993,088

(22) Filed: Jan. 11, 2016

(65) Prior Publication Data

US 2016/0123087 A1 May 5, 2016

Related U.S. Application Data

(63) Continuation of application No. 12/400,678, filed on Mar. 9, 2009, now Pat. No. 9,771,760.

(51) Int. Cl.

| | |
|---|---|
| ***E21B 10/42*** | (2006.01) |
| ***E21B 10/43*** | (2006.01) |
| ***E21B 10/567*** | (2006.01) |
| ***E21B 21/14*** | (2006.01) |

(52) U.S. Cl.

CPC ..... *E21B 10/42* (2013.01); *E21B 10/43* (2013.01); *E21B 10/567* (2013.01); *E21B 21/14* (2013.01)

(58) Field of Classification Search

CPC ..... E21B 10/003; E21B 2010/561; E21B 10/567; E21B 10/43; E21B 10/46; E21B 10/42; E21B 21/14; E21B 10/54; E21B 10/56; E21B 10/562; E21B 2010/5673

See application file for complete search history.

(56) References Cited

U.S. PATENT DOCUMENTS

| | | | |
|---|---|---|---|
| 2,819,043 | A | 1/1958 | Henderson |
| 3,251,425 | A | 5/1966 | Bridwell et al. |
| 4,194,790 | A | 3/1980 | Kenny et al. |

(Continued)

FOREIGN PATENT DOCUMENTS

| | | |
|---|---|---|
| EP | 1170460 | 1/2002 |
| GB | 2355035 | 4/2001 |
| GB | 2370300 | 6/2002 |

OTHER PUBLICATIONS

Search Report and Written Opinion dated Dec. 28, 2010 in corresponding Application No. PCT/US10/026528.

*Primary Examiner* — Wei Wang
(74) *Attorney, Agent, or Firm* — FisherBroyles, LLP

(57) ABSTRACT

A rotary drill bit for drilling formations in dry-drilling environments is disclosed. The rotary drill bit may include a bit body rotatable about a central axis. The rotary drill bit may also include at least one cutting element coupled to the bit body. The at least one cutting element may have a cutting face, a cutting edge adjacent the cutting face, and a back surface opposite the cutting face. The at least one cutting element may be oriented so that a substantial portion of the cutting edge has a positive clearance angle, which may be defined by a first vector that is normal to the cutting face and a second vector that is tangential to a helical path traveled by the cutting edge during drilling.

20 Claims, 16 Drawing Sheets

(56) References Cited

U.S. PATENT DOCUMENTS

| | | | | |
|---|---|---|---|---|
| 4,354,559 | A | 10/1982 | Johnson | |
| 4,550,791 | A | 11/1985 | Isakov | |
| 5,303,787 | A | 4/1994 | Brady | |
| 5,429,199 | A | 7/1995 | Sheirer et al. | |
| 6,202,770 | B1 | 3/2001 | Jurewicz et al. | |
| 6,374,932 | B1 | 4/2002 | Brady | |
| 6,460,631 | B2 | 10/2002 | Dykstra et al. | |
| 6,860,344 | B2 | 3/2005 | Bise et al. | |
| 7,951,213 | B1 * | 5/2011 | Miess ..... | B24D 99/005 175/420.2 |
| 2006/0283637 | A1 | 12/2006 | Viel et al. | |
| 2007/0278017 | A1 | 12/2007 | Shen et al. | |
| 2008/0185189 | A1 | 8/2008 | Griffo et al. | |

* cited by examiner

ROTATIONAL DRILL BITS AND DRILLING APPARATUSES INCLUDING THE SAME

CROSS REFERENCE TO RELATED APPLICATIONS

This application is a continuation of U.S. patent application Ser. No. 12/400,678, titled "ROTATIONAL DRILL BITS AND DRILLING APPARATUSES INCLUDING THE SAME" and filed 9 Mar. 2009, the disclosure of which is hereby incorporated, in its entirety, by this reference.

BACKGROUND

Cutting elements are traditionally utilized for a variety of material removal processes, such as machining, cutting, and drilling. For example, tungsten carbide cutting elements have been used for machining metals and, to some degree, on drilling tools for drilling subterranean formations. Similarly, polycrystalline diamond compact (PDC) cutters have been used to machine metals (e.g., non-ferrous metals) and on subterranean drilling tools, such as drill bits, reamers, core bits, and other drilling tools. Other types of cutting elements, such as ceramic (e.g., cubic boron nitride, silicon carbide, and the like) cutting elements or cutting elements formed of other materials have also been utilized for cutting operations.

Drill bit bodies to which cutting elements are attached are often formed of steel or of molded tungsten carbide. Drill bit bodies formed of molded tungsten carbide (so-called matrix-type bit bodies) are typically fabricated by preparing a mold that embodies the inverse of the desired topographic features of the drill bit body to be formed. Tungsten carbide particles are then placed into the mold and a binder material, such as a metal including copper and tin, is melted or infiltrated into the tungsten carbide particles and solidified to form the drill bit body. Steel drill bit bodies, on the other hand, are typically fabricated by machining a piece of steel to form the desired external topographic features of the drill bit body.

In some situations, drill bits employing cutting elements may be used in subterranean mining to drill roof-support holes. For example, in underground mining operations, such as coal mining, tunnels must be formed underground. In order to make the tunnels safe for use, the roofs of the tunnels must be supported in order to reduce the chances of a roof cave-in and to shield mine workers from various debris falling from the roof. In order to support a roof in a mine tunnel, boreholes are typically drilled into the roof using a drilling apparatus. The drilling apparatus commonly includes a drill bit attached to a drilling rod. Roof bolts are then inserted into the boreholes to anchor a support panel to the roof.

Various types of cutting elements, such as PDC cutters, have been employed for drilling boreholes for roof bolts. Although other configurations are known in the art, PDC cutters typically comprise a substantially circular diamond "table" formed on and bonded (under high-pressure and high-temperature conditions) to a supporting substrate, such as a cemented tungsten carbide (WC) substrate.

As illustrated in FIG. 23, a conventional drill bit 120 for drilling roof-bolt boreholes may include two circular cutting elements 122 disposed radially outward relative to a central axis of drill bit 120. Unfortunately, the shape and orientation of cutting elements 122 on drill bit 120 may cause rifling of a borehole cut by drill bit 120. Further, cutting elements 122 may cause drill bit 120 to "walk" or wander across a surface to be drilled, rather than remaining centered at a desired point on the surface. Additionally, conventional drill bits having circular cutting elements may have a relatively small effective cutting surface relative to the diameter of the drill bit, reducing the overall effectiveness of the drill bit in cutting subterranean formations.

SUMMARY

The instant disclosure is directed to exemplary rotary drill bits for drilling formations in dry-drilling environments. In some examples, a rotary drill bit may comprise a bit body that comprises a forward end and a rearward end and is rotatable about a central axis. The rotary drill bit may also comprise at least one cutting element coupled to the bit body. Each cutting element may comprise a cutting face, a cutting edge adjacent the cutting face, and a back surface opposite the cutting face. The cutting element may be oriented so that a majority of the cutting edge has a positive clearance angle. The clearance angle may be defined by a first vector that is generally normal to the cutting face and a second vector that is generally tangential to a helical path traveled by the cutting edge during drilling.

In one example, at least approximately 85% of the cutting edge may have a positive clearance angle. In an additional example, the positive clearance angles within the substantial portion may vary by no more than approximately 40°. Further, the cutting edge may have a maximum negative clearance angle of approximately −40°. The drill bit may be moved in the axially forward direction at a rate of between approximately 120 ft/hr and approximately 850 ft/hr. The drill bit may also be rotated about the central axis at a rate of between approximately 300 revolutions per minute and approximately 800 revolutions per minute.

In some examples, the rotary drill bit may include a plurality of cutting elements spaced substantially uniformly about the central axis. In this example, the cutting elements may be oriented to form a substantially apical cutting tip extending from the forward end of the bit body.

The rotary drill bit may also comprise a vacuum hole defined in the bit body that is configured to draw debris away from the cutting elements. The vacuum hole may extend from an opening in a rearward end of the bit body to a side opening in the bit body. The side opening may be disposed axially rearward relative to the cutting elements. In one example, the vacuum hole extends from an opening in the rearward end of the bit body to an opening defined between two or more cutting elements at the forward end of the bit body.

The rotary drill bit may also comprise at least one debris channel defined in the bit body adjacent the cutting elements. In some examples, the debris channel may be configured to guide debris to the vacuum hole. The debris channel may extend between the forward end of the bit body and the side opening in the bit body.

In various examples, the back surface of each cutting element may be coupled to the bit body. Each cutting element may also comprise a superabrasive material (such as polycrystalline diamond) bonded to a substrate. At least a portion of the superabrasive material may be at least partially leached. In some examples, each cutting element may be oriented at a back-rake angle of between approximately 5° and 45°. Additionally, each cutting element may be oriented so that at least a majority of each side surface avoids contacting a formation during drilling.

An exemplary drilling apparatus for drilling formations in dry-drilling environments is also disclosed. This drilling apparatus may comprise a drill rod and a bit body coupled to the drill rod. The drilling apparatus may also comprise at least one cutting element coupled to the bit body. The at least one cutting element may be oriented so that a substantial portion of the cutting edge has a positive clearance angle.

Features from any of the above-mentioned embodiments may be used in combination with one another in accordance with the general principles described herein. These and other embodiments, features, and advantages will be more fully understood upon reading the following detailed description in conjunction with the accompanying drawings and claims.

BRIEF DESCRIPTION OF THE DRAWINGS

The accompanying drawings illustrate a number of exemplary embodiments and are a part of the specification. Together with the following description, these drawings demonstrate and explain various principles of the instant disclosure.

Figure 1:
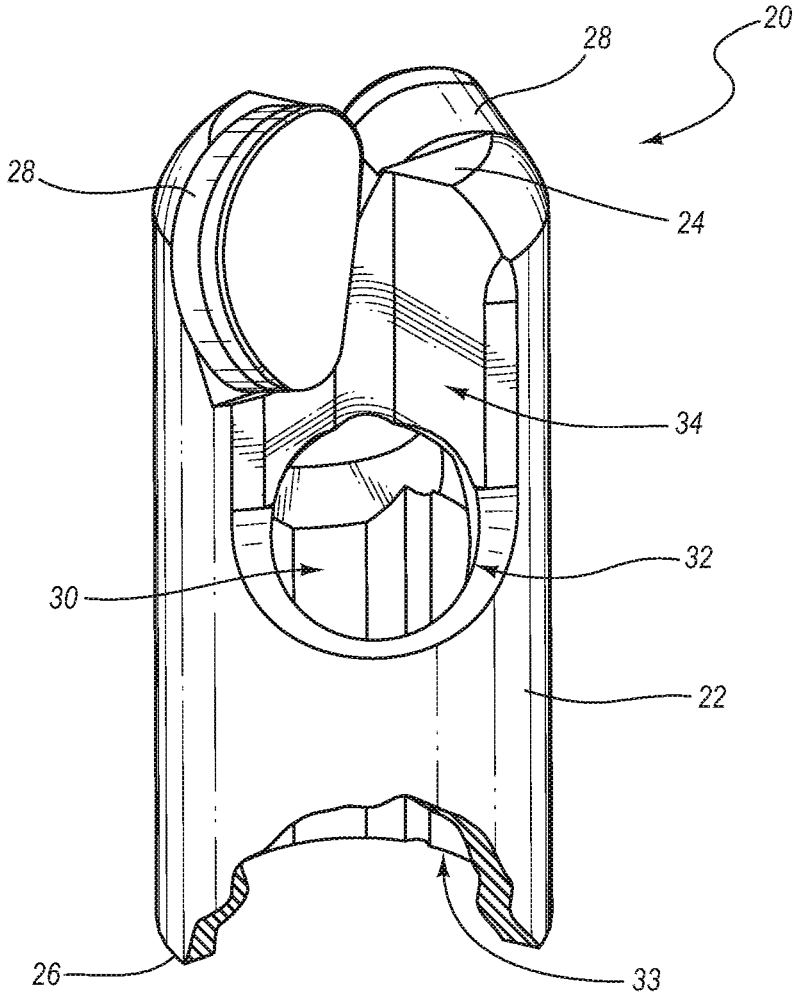
FIG. 1 is a partial cut-away perspective view of an exemplary drill bit according to at least one embodiment.

Throughout the drawings, identical reference characters and descriptions indicate similar, but not necessarily identical, elements. While the exemplary embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION OF EXEMPLARY EMBODIMENTS

The instant disclosure is directed to exemplary rotary drill bits for drilling formations in various environments, including dry-drilling environments. The phrase "dry-drilling environment," as used herein, generally refers to drilling operations that do not utilize drilling mud or other lubricants when cutting or drilling formations. In at least one embodiment, a dry-drilling-environment rotary drill bit may be used to drill holes in subterranean formations, such as rock formations. For example, the rotary drill bit may be coupled to a drill rod and rotated by a rotary drill apparatus configured to rotate the rotary drill bit relative to a formation. The instant disclosure may also apply to rotary drill bits used in other suitable environments, including, for example, wet-drilling environments.

For ease of use, the words "including" and "having," as used in this specification and claims, are interchangeable with and have the same meaning as the word "comprising." In addition, the word "cutting" may refer broadly to machining processes, drilling processes, boring processes, or any other material removal process utilizing a cutting element.

FIG. 1 is a partial cut-away perspective view of an exemplary drill bit 20 according to at least one embodiment. Drill bit 20 may represent any type or form of earth-boring or drilling tool, including, for example, a rotary borehole drill bit. Drill bit 20 may be formed of any material or combination of materials, such as steel or molded tungsten carbide, without limitation.

As illustrated FIG. 1, drill bit 20 may comprise a bit body 22 having a forward end 24 and a rearward end 26. At least one cutting element 28 may be coupled to bit body 22. For example, as shown in FIG. 1, a plurality of cutting elements 28 may be coupled to a forward portion of bit body 22. Cutting elements 28 may be coupled to bit body 22 using any suitable technique, including, for example, brazing or welding.

In at least one embodiment, a vacuum hole 30 may be defined in bit body 22. As illustrated in FIG. 1, in some embodiments vacuum hole 30 may extend from a rearward opening 33 defined in rearward end 26 of bit body 22 to at least one side opening 32 defined in a side wall of bit body 22. As shown in FIG. 1, side opening 32 may be disposed adjacent cutting elements 28. Side opening 32 may also be disposed axially rearward of cutting elements 28 (i.e., between cutting elements 28 and rearward end 26 of bit body 22). In one example, vacuum hole 30 may be configured to draw debris, such as rock or formation cuttings, away from cutting elements 28. For example, a vacuum source may be attached to rearward opening 33 of vacuum hole 30 to draw debris and other formation cuttings away from cutting elements 28 and into side opening 32.

In some examples, at least one debris channel 34 may be defined in bit body 22 in order to guide debris, such as rock or formation cuttings, into vacuum hole 30 (e.g., side opening 32 of vacuum hole 30). Debris channel 34 may be formed in a variety of shapes and sizes, such as the substantially concave shape illustrated in FIGS. 1 and 8. In one example, debris channel 34 may be disposed adjacent at least one of cutting elements 28 and may extend between forward end 24 of bit body 22 and side opening 32.

Figure 2:
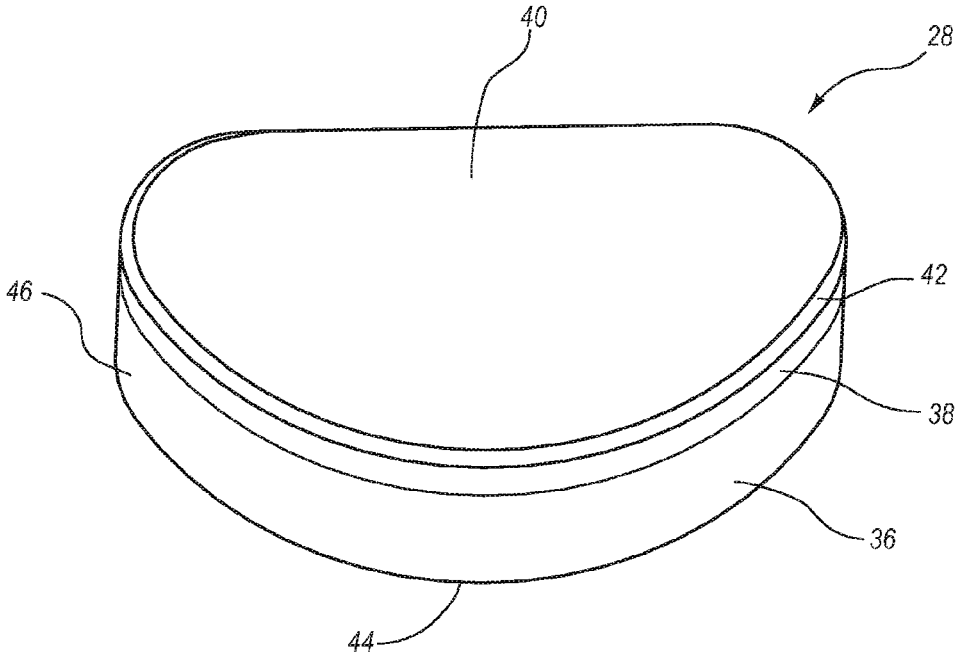
FIG. 2 is a perspective view of an exemplary cutting element according to at least one embodiment.

FIG. 2 is a perspective view of an exemplary cutting element 28 that may be coupled to exemplary bit body 22 in FIG. 1. As illustrated in this figure, cutting element 28 may comprise a layer or table 38 affixed to or formed upon a substrate 36. Table 38 may be formed of any material or combination of materials suitable for cutting formations, including, for example, a superhard or superabrasive material such as polycrystalline diamond (PCD). The word "superhard," as used herein, may refer to any material having a hardness that is at least equal to a hardness of tungsten carbide. Similarly, substrate 36 may comprise any material or combination of materials capable of adequately supporting a superabrasive material during drilling of a subterranean formation, including, for example, cemented tungsten carbide.

For example, cutting element 28 may comprise a table 38 comprising polycrystalline diamond bonded to a substrate 36 comprising cobalt-cemented tungsten carbide. In at least one embodiment, after forming table 38, a catalyst material (e.g., cobalt or nickel) may be at least partially removed from table 38. A catalyst material may be removed from table 38 using any suitable technique, such as, for example, acid leaching. In some examples, table 38 may be exposed to a leaching solution until a catalyst material is substantially removed from table 38 to a desired depth relative to one or more surfaces of table 38.

In at least one embodiment, substrate 36 may be at least partially covered with a protective layer, such as, for example, a polytetrafluoroethylene cup, to prevent corrosion of substrate 36 during leaching. In additional embodiments, table 38 may be separated from substrate 36 prior to leaching table 38. For example, table 38 may be removed from substrate 36 and placed in a leaching solution so that all surfaces of table 38 are at least partially leached. In various examples, table 38 may be reattached to substrate 36 or attached to a new substrate 36 following leaching. Table 38 may be attached to substrate 36 using any suitable technique, such as, for example, brazing, welding, or HPHT processing.

As shown in FIG. 2, cutting element 28 may also comprise a cutting face 40 formed by table 38, a side surface 46 formed by table 38 and substrate 36, and a back surface 44 formed by substrate 36. According to various embodiments, cutting face 40 may be substantially planar and side surface 46 may be substantially perpendicular to cutting face 40. Back surface 44 may be opposite and, in some embodiments, substantially parallel to cutting face 40.

Cutting face 40 and side surface 46 may be formed in any suitable shape, without limitation. In one example, cutting face 40 may have a substantially arcuate periphery. In another example, cutting face 40 may have a substantially semi-circular periphery. For example, two cutting elements 28 may be cut from a single substantially circular cutting element blank, resulting in two substantially semi-circular cutting elements 28. In some examples, angular portions of side surface 46 may be rounded to form a substantially arcuate surface around cutting element 28.

As illustrated in FIG. 2, cutting element 28 may also comprise a cutting edge 42 formed along at least a portion of a periphery of table 38 at an intersection between cutting face 40 and side surface 46. In some embodiments, and as illustrated FIG. 2, cutting edge 42 may be chamfered (i.e., sloped or angled). Cutting edge 42 may be configured to contact and/or cut a formation as drill bit 20 is rotated relative to the formation (as will be described in greater detail below in connection with FIG. 5). In at least one embodiment, cutting edge 42 may refer to an edge portion of cutting element 28 that is exposed to and/or in contact with a formation during drilling.

Figure 3:
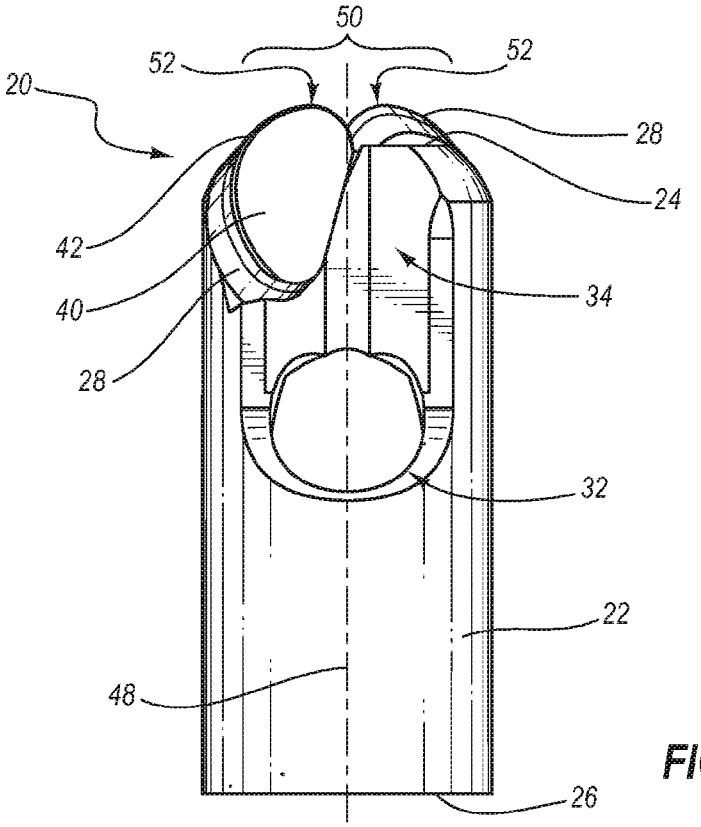
FIG. 3 is a side view of an exemplary drill bit according to at least one embodiment.
Figure 4:
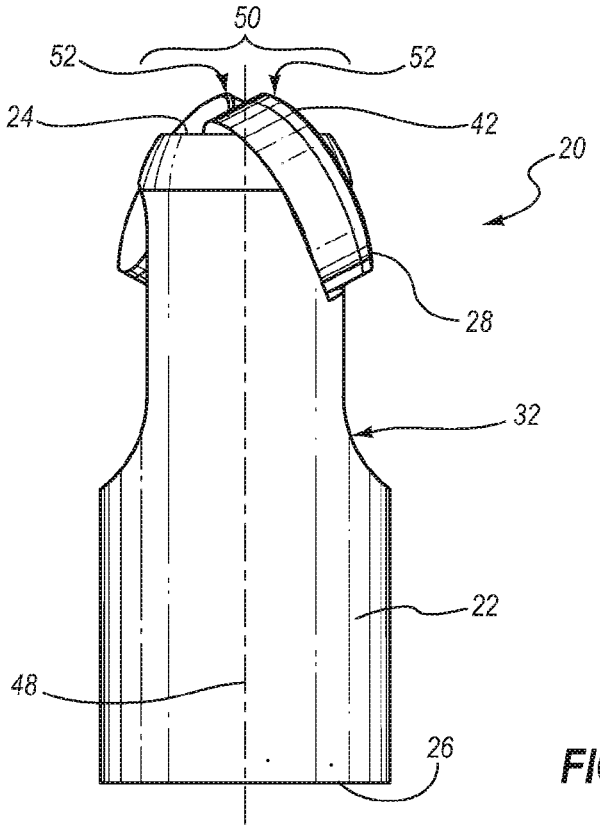
FIG. 4 is an additional side view of the exemplary drill bit illustrated in FIG. 3.

FIGS. 3 and 4 are side views of the exemplary drill bit 20 illustrated in FIG. 1. As illustrated in these figures, drill bit 20 may be centered around and/or may be rotatable about a central axis 48. Central axis 48 may extend in a lengthwise direction through drill bit 20.

In some embodiments, cutting elements 28 may be substantially centered and/or uniformly spaced about central axis 48. Cutting elements 28 may also be oriented about central axis 48 so as to form a substantially apical cutting tip 50 extending from forward end 24 of bit body 22. For example, cutting elements 28 may be: 1) positioned both adjacent to central axis 48 and to one another and 2) oriented at an angle relative to central axis 48 (as discussed in greater detail below in connection with FIG. 7) in order to form a substantially apical cutting tip 50 at forward end 24 of bit body 22. In some embodiments, cutting elements 28 may also be positioned so that cutting edges 42 form a generally arcuate periphery of apical cutting tip 50. In one example, forming cutting elements 28 so as to be substantially semi-circular (as opposed to substantially circular, as is common in the art) may enable cutting elements to be oriented about central axis 48 in a manner that forms substantially apical cutting tip 50.

Figure 9:
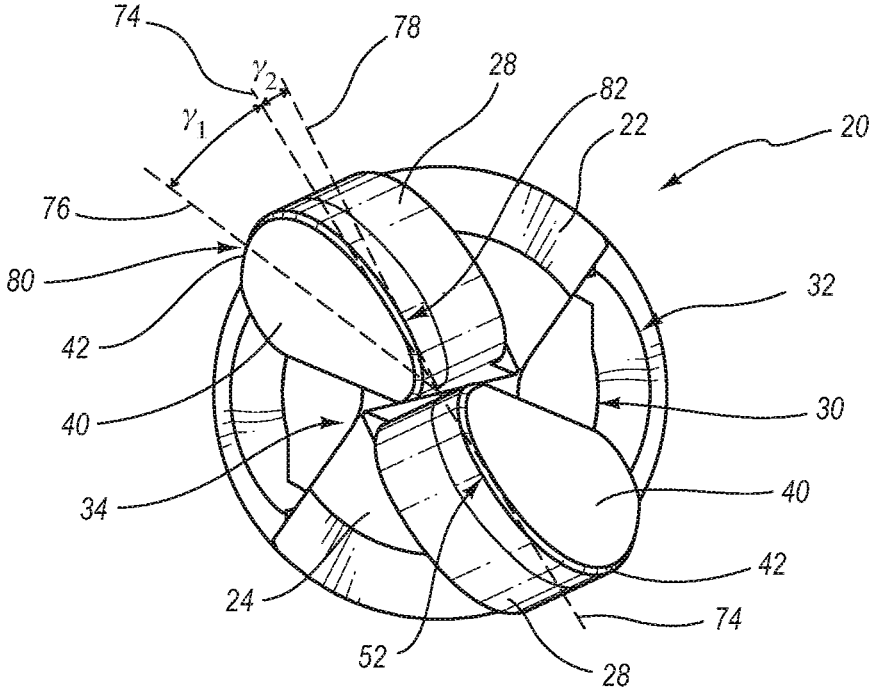
FIG. 9 is a top view of an exemplary drill bit according to at least one embodiment.

In at least one embodiment, cutting elements 28 may be oriented so that a forward edge portion 52 of each cutting edge 42 that is most axially distant from forward end 24 of bit body 22 (as illustrated in FIGS. 3, 4, and 9) is positioned in close proximity to central axis 48. Accordingly, as drill bit 20 is rotated relative to a formation surface, such as a surface of a subterranean formation, forward edge portions 52 of cutting elements 28 may directly contact the formation surface. In this example, because forward edge portions 52 are in close proximity to both central axis 48 and to one another, drill bit 20 may be more easily centered on the formation surface, particularly when a new hole is being started in the formation. For example, the close proximity of forward edge portions 52 of cutting elements 28 to central axis 48 and/or to each other may prevent "walking" or wandering of drill bit 20 on the formation surface, thereby enabling a hole to be drilled in the formation with greater ease and accuracy.

Figure 5:
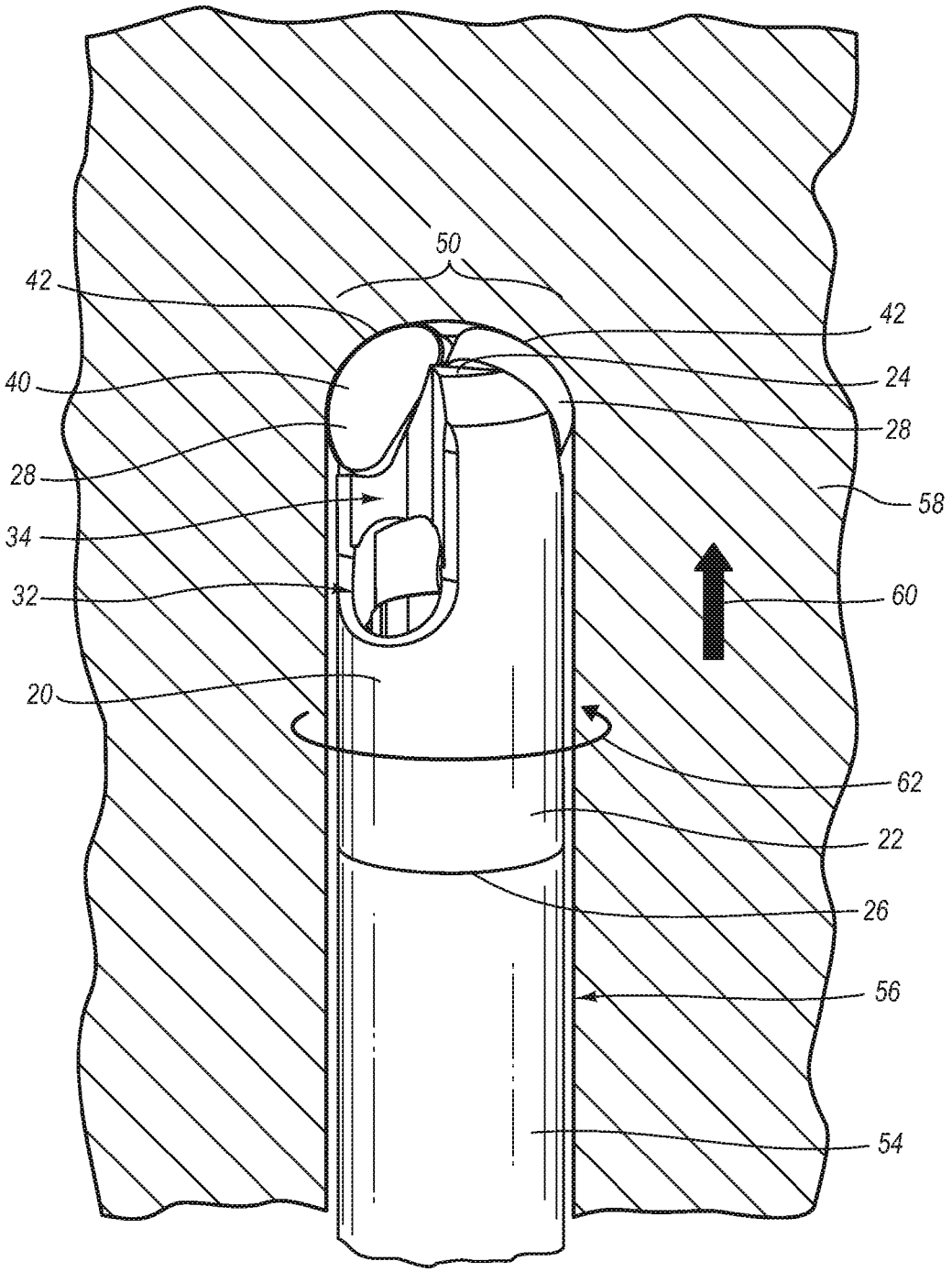
FIG. 5 is a partial cross-sectional side view of an exemplary drill bit as it is rotated relative to a formation.

FIG. 5 is a partial cross-sectional side view of an exemplary drill bit 20 drilling or cutting a borehole 56 in a formation 58. As illustrated in this figure, drill bit 20 may be coupled to a drill rod 54. Drill rod 54 may comprise any suitable type of drill rod or drill string configured to couple drill bit 20 to a drilling apparatus. In some examples, drill rod 54 may comprise a substantially elongated and/or cylindrical shaft. According to at least one embodiment, force may be applied by a drilling apparatus to drill bit 20 via drill rod 54, causing drill bit 20 to be forced against formation 58 in both a forward direction 60 and a rotational direction 62. As force is applied to drill bit 20 in rotational direction 62, drill bit 20 may be rotated relative to formation 58 in rotational direction 62. As illustrated in FIG. 5, cutting faces 40 on cutting elements 28 may face generally in rotational direction 62 and may be angled with respect to rotational direction 62.

The position and orientation of cutting elements 28 may facilitate drilling of borehole 56 in formation 58 and/or may reduce rifling of borehole 56 as drill bit 20 is rotated within borehole 56. The word "rifling," as used herein, may refer to the formation of a spiral or helical cut or groove in a hole, such as a borehole. In particular, cutting elements 28 may be positioned on drill bit 20 so that significant portions of cutting edges 42 extend axially forward and/or radially outward relative to drill bit 20. As illustrated in FIG. 5, cutting edges 42 may extend in an arcuate manner from a forward portion of borehole 56 adjacent central axis 48 to a radially peripheral side portion of borehole 56. Accordingly, significant portions of cutting edges 42 may contact formation 58 as drill bit 20 is rotated within borehole 56, facilitating relatively even and consistent cutting of formation 58.

As drill bit 20 is forced against formation 58 and rotated relative to formation 58, material in the form of cuttings may be removed from formation 58. Cuttings may comprise pulverized material, fractured material, sheared material, a continuous chip, or any other form of cutting, without limitation. As cuttings are removed from formation 58, the cuttings may be guided toward side openings 32 by debris channels 34. In at least one embodiment, debris, including the cuttings removed from formation 58, may be directed across cutting faces 40 and/or forward end 24 of bit body 22 toward debris channels 34. The substantially concave shape of debris channels 34 may then guide the debris toward side openings 32.

In some examples, side openings 32 may be configured to allow debris in debris channels 34 to pass substantially unimpeded from debris channels 34 through side openings 32 and into vacuum hole 30, which may extend to rearward opening 33. Additionally, rearward opening 33 may open into a vacuum hole that extends through drill rod 54 and is coupled to a vacuum assembly located external to drill rod 54. In this embodiment, a vacuum applied to vacuum hole 30 in bit body 22 may generate significant suction near side opening 32, which may in turn facilitate the drawing of debris away from borehole 56 and cutting elements 28. In some embodiments, the shape and diameter of vacuum hole 30 and/or side opening 32 may be formed to optimize the amount of suction generated near forward end 24 of drill bit 20.

In addition, a vacuum applied to vacuum hole 30 may facilitate cooling of cutting elements 28 and/or any other portion of drill bit 20. For example, cutting elements 28 may be cooled through convective heat transfer as air and debris are drawn over and around cutting elements 28. Debris channels 34 may further facilitate cooling of cutting elements 28 as air and debris are drawn under suction from vacuum hole 30 past cutting edges 42, cutting faces 40, and/or side surfaces 46 toward and through debris channels 34 adjacent cutting elements 28.

Figure 6:
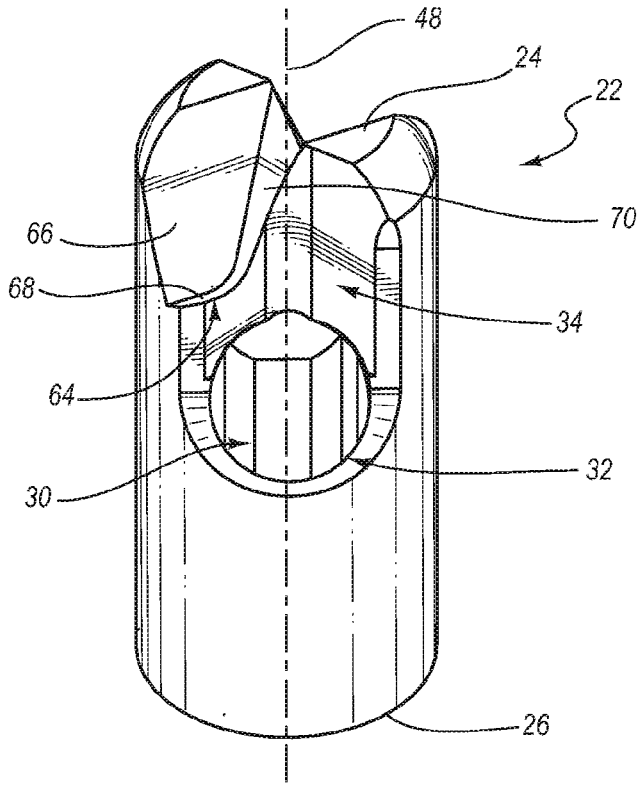
FIG. 6 is a perspective view of an exemplary bit body according to at least one embodiment.
Figure 7:
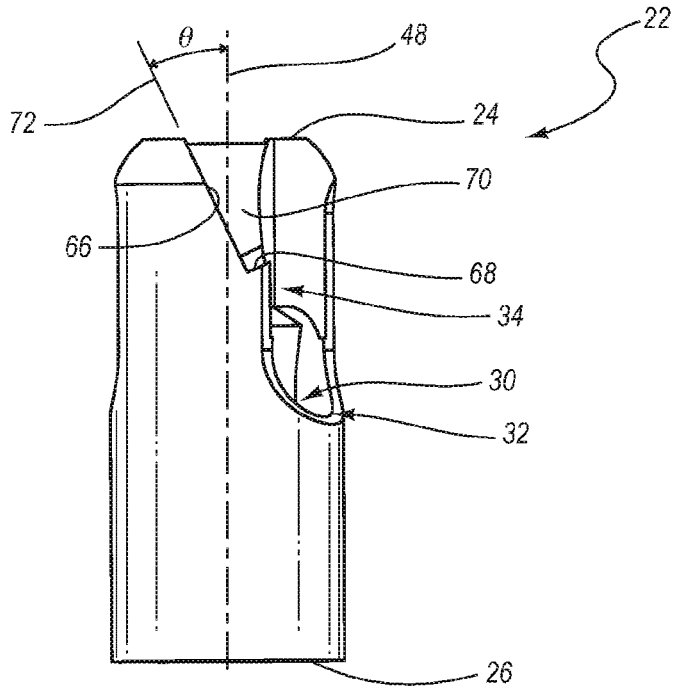
FIG. 7 is side view of the exemplary bit body illustrated in FIG. 6.
Figure 8:
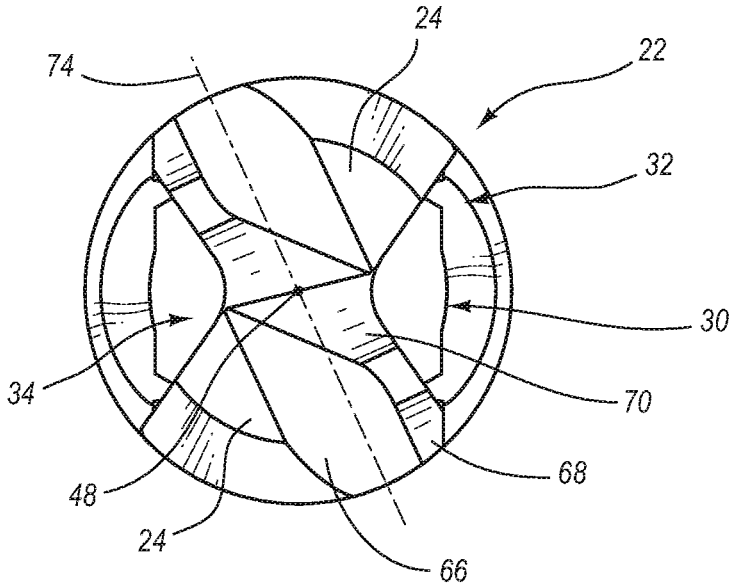
FIG. 8 is a top view of the exemplary bit body illustrated in FIG. 6.

FIGS. 6-8 illustrate an exemplary bit body 22 according to various embodiments. As shown in these figures, at least a portion of bit body 22 may have a substantially cylindrical profile. For example, a rearward, or shank, portion of bit body 22 may have a cylindrical shape substantially centered around central axis 48. In this example, central and/or forward portions of bit body 22 may extend to radial distances relative to central axis 48 that are substantially equivalent to the outer diameter of a rearward cylindrical portion of bit body 22.

According to at least one embodiment, at least one recess 64 may be defined in bit body 22 in order to facilitate coupling a corresponding cutting element 28 to bit body 22. For example, as illustrated in FIGS. 6-8, two recesses 64 may be defined in bit body 22 substantially opposite one another relative to central axis 48. Recesses 64 may be formed in any suitable shape or size and may be located at any suitable position and orientation on bit body 22. In various embodiments, as shown in these figures, recesses 64 may be formed adjacent debris channels 34. Additionally, recesses 64 may extend to forward end 24 of bit body 22.

Each of recesses 64 may be defined by a mounting surface 66 and at least one substantially perpendicular support surface (e.g., support surfaces 68 and 70, each of which may be substantially perpendicular to mounting surface 66). In some examples, mounting surface 66 may comprise a substantially planar surface in order to facilitate brazing, welding, or otherwise attaching a back surface 44 of cutting element 28 to bit body 22.

As illustrated in FIG. 7, mounting surface 66 may be oriented so as to define a back-rake angle θ with respect to central axis 48. As used herein, the phrase "back-rake angle" may refer to an angular difference between central axis 48 and mounting surface 66. For example, as shown in FIG. 7, back-rake angle θ may represent an angular difference between central axis 48 and a line 72 that extends parallel to mounting surface 66. In some examples, a cutting element (such as cutting element 28 in FIGS. 1-4) may be mounted substantially parallel to mounting surface 66 so that the cutting face of the cutting element has substantially the same back-rake angle θ as mounting surface 66.

Back-rake angle θ in FIG. 7 may be selected so as to optimize the performance of drill bit 20 when drilling formations. For an example, a relatively low back-rake angle θ may decrease the amount of heat generated in cutting element 28 as it contacts and is moved by drill bit 20 relative to a formation. Conversely, a relatively high back-rake angle θ may increase the fracture resistance and cutting effectiveness of cutting element 28. Back-rake angle θ may also be selected so as to improve self-centering of drill bit 20 and reduce walking of drill bit 20 across a formation surface when a new hole is started in the formation. In at least one embodiment, mounting surface 66 may be oriented to define a back-rake angle θ of between approximately 5° and 45°. In additional embodiments, mounting surface 66 may be oriented to define a back-rake angle θ of between approximately 15° and approximately 30°. Mounting surface 66 may also be oriented to define a back-rake angle θ of between approximately 20° and approximately 25°.

As detailed above, and as shown in FIGS. 6-8, recesses 64 may also be defined by one or more support surfaces, such as rearward support surface 68 and/or side support surface 70. Rearward support surface 68 and/or side support surface 70 may extend from mounting surface 66 at any suitable angle. For example, rearward support surface 68 and/or side support surface 70 may extend from mounting surface 66 at a substantially perpendicular angle. In at least one embodiment, rearward support surface 68 and or side support surface 70 may be formed so as to be adjacent and/or in contact with a corresponding portion of a side surface 46 of cutting element 28. Additionally, side support surface 70 may intersect central axis 48, thereby enabling a corresponding cutting element 28 to be disposed in relatively close proximity to central axis 48. For example, as illustrated in FIG. 6, two side support surfaces 70 may intersect one another at central axis 48, enabling corresponding cutting elements 28 to form a substantially apical cutting tip 50 substantially centered about central axis 48.

Rearward support surface 68 may be configured to provide support for a rearward portion of a corresponding cutting element 28. Similarly, side support surface 70 may be configured to provide support for a side portion of a corresponding cutting element 28 that extends between a rearward and a forward portion of cutting element 28. Each of rearward support surface 68 and side support surface 70 may be configured to counteract forces imposed on a cutting element 28 mounted to a corresponding recess 64 as drill bit 20 is rotated relative to a formation. Accordingly, rearward support surface 68 and/or side support surface 70 may help prevent detachment of cutting element 28 from bit body 22 and may help maintain the orientation of cutting element 28 relative to bit body 22.

FIG. 8 is a top view of the exemplary bit body 22 illustrated in FIGS. 6 and 7. Similarly, FIG. 9 is a top view of an exemplary drill bit 20 comprising a plurality of cutting elements 28 mounted to bit body 22. As shown in these figures, side openings 32 may be defined in bit body 22 so that they open to a forward portion of drill bit 20. Looking down on exemplary bit body 22 from a view axially forward of bit body 22, as shown in FIG. 8, vacuum hole 30 can be seen extending axially through bit body 22 from side openings 32 to rearward end 26 of bit body 22. As can be seen in FIG. 9, side openings 32 may be defined in bit body 22 so that debris may be effectively channeled by debris channel 34 through side openings 32 to vacuum hole 30.

In some embodiments, and as shown in FIG. 9, an angular difference $\gamma_1$ between: 1) a radial line 76 that extends from central axis 48 to a location 80 on cutting edge 42 that is located most radially distant from central axis 48 and 2) a radial line 74 that extends from central axis 48 in a direction parallel to cutting face 40 (and/or mounting face 66, which, as described above, may be substantially parallel to cutting face 40) may be positive. In this example, the angular difference $\gamma_1$ may be between approximately 0° and 40°.

Conversely, an angular difference $\gamma_2$ between: 1) a radial line 78 that extends from central axis 48 to a location 82 on forward edge portion 52 of cutting edge 42 that is located most axially distant from forward end 24 of bit body 22 and 2) a radial line 74 that extends from central axis 48 in a direction parallel to cutting face 40 may be negative. In this example, the angular difference $\gamma_2$ may be between approximately 0° and −25°.

In some examples, a portion of cutting element 28 between radial line 76 and radial line 74 may lead in front of radial line 74 as drill bit 20 is rotated relative to a formation. Further, those portions of cutting element 28 between radial line 78 and radial line 74 may trail behind radial line 74 as drill bit 20 is rotated relative to a formation.

The shape, position, and orientation of cutting element 28 may be selected so as to increase the effectiveness of drill bit 20 in cutting a hole in a formation, to improve self-centering of drill bit 20, and to prevent drill bit 20 from "walking" across the surface of a formation when a new hole is started in the formation. In at least one example, cutting element 28 may be shaped, positioned, and oriented on bit body 22 such that a substantial portion of cutting edge 42 has a positive clearance angle as drill bit 20 is rotated about central axis 48. The phrase "clearance angle," as used herein, generally refers to an angular difference between: 1) a vector that is perpendicular to cutting face 40 of cutting element 28 and 2) a vector that is tangential to a helical path traveled by cutting edge 42 of cutting element 28 as drill bit 20 is rotated about central axis 48 and moved in an axially forward direction.

Figure 10:
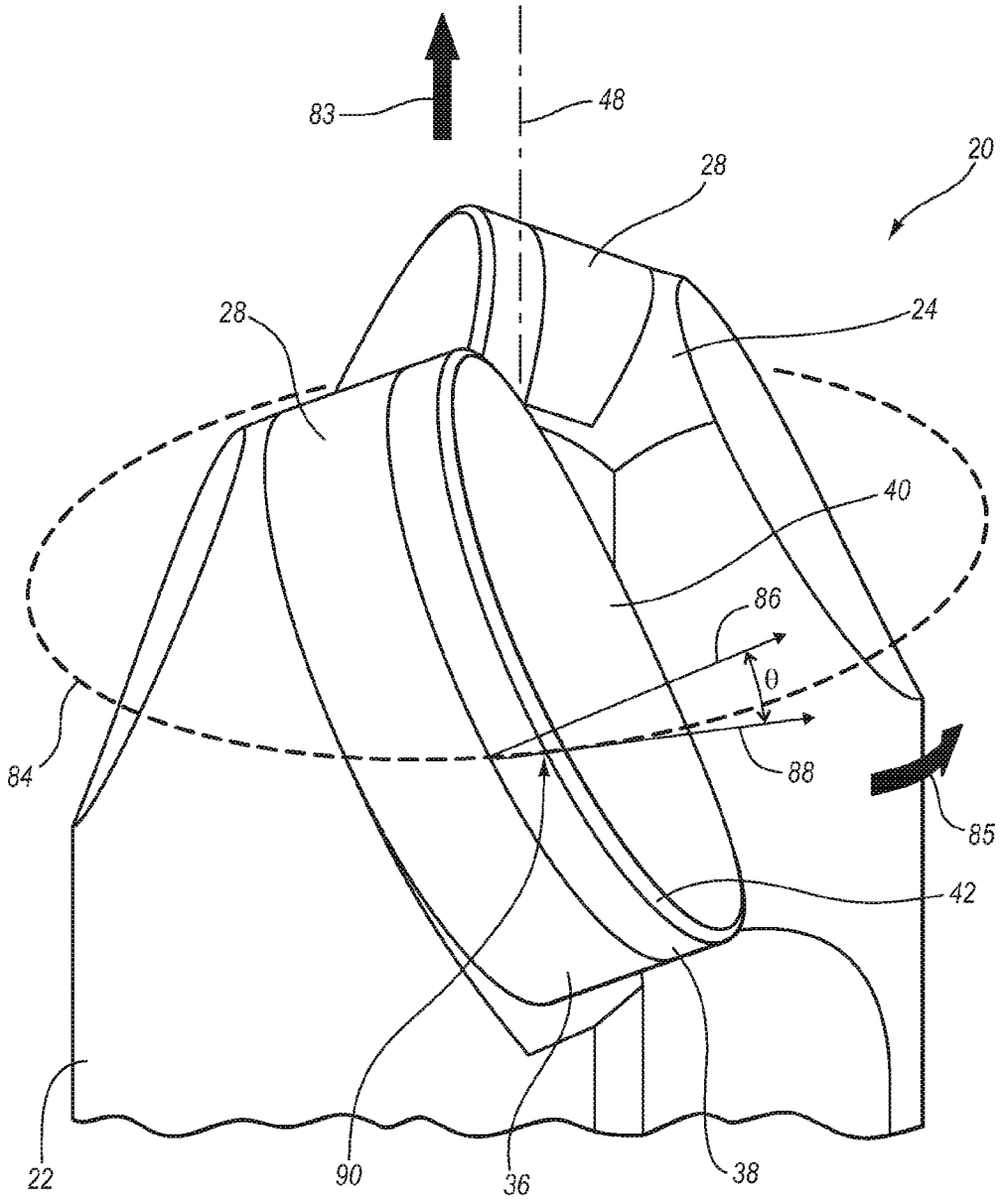
FIG. 10 is a perspective view of an axially forward portion of an exemplary drill bit as it is rotated according to at least one embodiment.

FIG. 10 is a perspective view of a forward portion of an exemplary drill bit 20. As illustrated in this figure, drill bit 20 may be simultaneously: 1) rotated about central axis 48 in a rotational direction 85 and 2) moved in an axially forward direction 83. For example, a drilling motor may cause drill bit 20 to simultaneously rotate in rotational direction 85 and move in axially forward direction 83.

As drill bit 20 is simultaneously moved in axially forward direction 83 and rotated about central axis 48, a cutting edge 42 of a cutting element 28 coupled to drill bit 20 may travel in a helical manner. Various portions of cutting edge 42 may follow different helical paths. For example, as shown in FIG. 10, a location 90 on cutting edge 42 may follow a helical path 84 as drill bit 20 is rotated about central axis 48 in rotational direction 85 and moved in axially forward direction 83. In some examples, helical path 84 may represent a path traveled by a formation relative to location 90 on cutting edge 42 during drilling.

The clearance angle at any location along cutting edge 42 may be determined based on the shape, position, and/or orientation of cutting element 28 on drill bit 20. The clearance angle may also be determined by the helical path traveled by cutting edge 42. For example, as illustrated in FIG. 10, clearance angle $\theta$ may be defined by a first vector 86 that is normal to cutting face 40 of cutting element 28 and a second vector 88 that is tangential to helical path 84 at location 90 on cutting edge 42.

Any location along cutting edge 42 may have a positive clearance angle $\theta$, a negative clearance angle $\theta$, or a clearance angle $\theta$ of 0°. As will be explained in greater detail below in connection with FIGS. 12 and 13, a side portion of cutting element 28 that is adjacent to a location on cutting edge 42 that has a positive clearance angle $\theta$ may avoid contacting a formation during drilling. Conversely, a side portion of cutting element 28 that is adjacent to a location on cutting edge 42 that has a negative clearance angle $\theta$ may be forced against a formation during drilling, which may cause wear and damage to cutting element 28 and/or drill bit 20.

Figure 11:
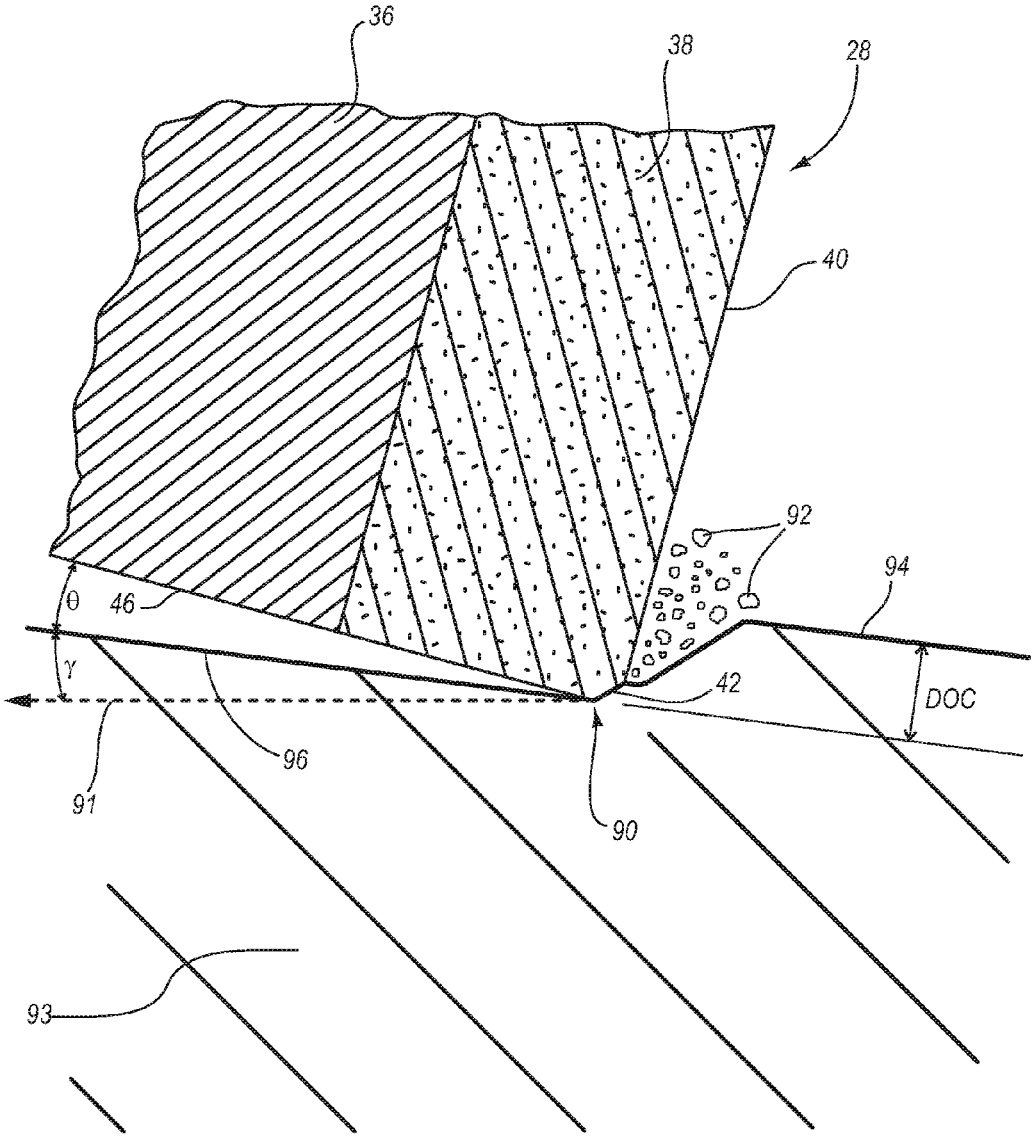
FIG. 11 is a cross-sectional view of an exemplary cutting element as it cuts a formation according to various embodiments.

FIG. 11 is a cross-sectional view of a portion of a cutting element 28 as it cuts a formation 93. As shown in this figure, cutting element 28 may have a positive clearance angle $\theta$ at a location 90 on cutting edge 42. Accordingly, as cutting element 28 moves relative to formation 93, a side surface 46 of cutting element 28 that is adjacent to location 90 may avoid contacting or dragging along formation 93.

As drill bit 20 is rotated, at least a portion of cutting edge 42 and a portion of cutting face 40 on superabrasive table 38 may engage formation 93, producing formation cuttings, or chips, 92 from formation 93. Prior to being cut by cutting element 28 during a particular rotation of drill bit 20, formation 93 may be defined by a first surface 94. After formation 93 is cut by cutting element 28 during the particular rotation, a second surface 96 may define formation 93. A difference between second surface 96 and first surface 94 may be referred to as the depth of cut (DOC). In this example, the DOC may be measured in a perpendicular direction relative to second surface 96.

FIG. 11 also illustrates a drilling reference plane 91 that is perpendicular to the axis of rotation of drill bit 20. Second surface 96 may be oriented at an angle $\gamma$ with respect to drilling reference plane 91. Second surface 96 may be substantially parallel to a helical path of cutting edge 42 (e.g., helical path 84 shown in FIG. 10) as the drill bit to which cutting element 28 is attached is rotated about a central axis and moved in an axially forward direction perpendicular to drilling reference plane 91. Accordingly, angle $\gamma$ may represent an angle of the helical path followed by location 90 on cutting element 28 relative to drilling reference plane 91 as drill bit 20 is rotated relative to formation 93. As can be seen in FIG. 11, because the helical path followed by location 90 on cutting element 28 is at an angle (e.g., angle $\gamma$) with respect to drilling reference plane 91, cutting edge 42 may cut into formation 93, forming second surface 96.

Figure 12:
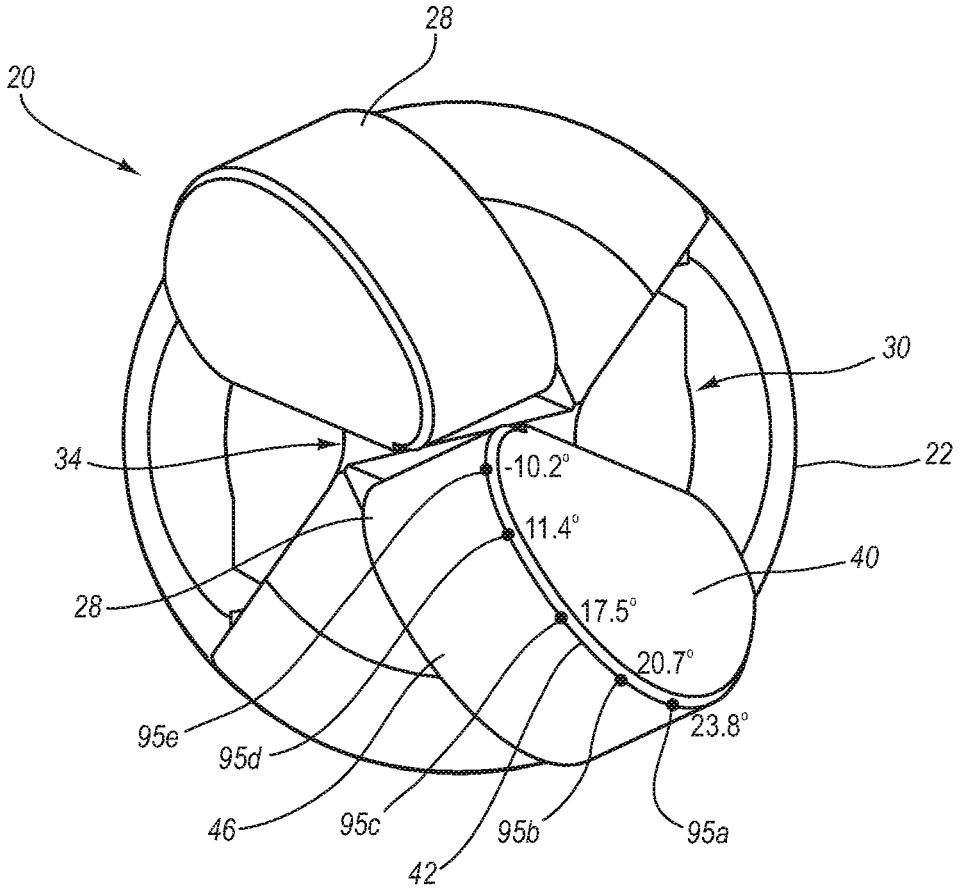
FIG. 12 is a top view of an exemplary drill bit according to at least one embodiment.
Figure 13:
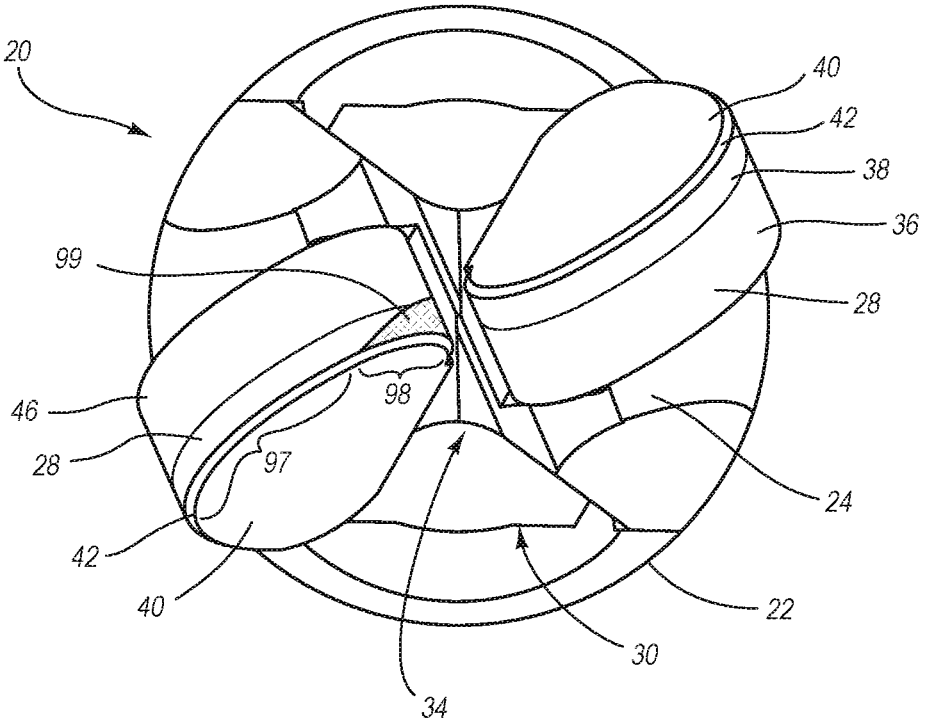
FIG. 13 is a top view of an exemplary drill bit according to at least one embodiment.

FIGS. 12 and 13 are top views of an exemplary drill bit 20 according to various embodiments. As illustrated in FIG. 12, the clearance angle may vary at different points along cutting edge 42 of cutting element 28. In one example, and as seen in FIG. 12, a substantial portion of cutting edge 42 of cutting element 28 may have a positive clearance angle. In some embodiments, the positive clearance angles within this substantial portion of cutting edge 42 may vary by no more than approximately 40°. For example, the maximum positive clearance angle along cutting edge 42 may be no more than approximately 40°. In an additional example, the positive clearance angles within this substantial portion of cutting edge 42 may vary by no more than approximately 30°. In this example, the maximum positive clearance angle along cutting edge 42 may be no more than approximately 30°. The amount and variation of the clearance angle along cutting edge 42 may be determined, at least in part, by the shape and orientation of cutting element 28 on drill bit 20.

In some examples, the various clearance angles along the cutting edge of a cutting element may vary in accordance with: 1) the rate of rotation of the drill bit about its central axis (commonly measured in revolutions per minute, or RPMs), 2) the rate at which the drill bit is moved in an axially forward direction (commonly measured in feet per hour and referred to as the rate of penetration, or ROP), and 3) the back-rake angle of the cutting element. Suitable ROP ranges for the various drill bit embodiments described herein may include between approximately 120 ft/hr and approximately 850 ft/hr. Similarly, suitable RPM ranges for the various drill bit embodiments described herein may include between approximately 300 RPMs and approximately 800 RPMs. In addition, as detailed above, suitable back-rake angles for the various cutting element embodiments described herein may include between approximately 5° and approximately 45°.

For example, as shown in FIG. 12, at least one cutting element 28 may be disposed on bit body 22 at a backrake angle of approximately 25°. As illustrated in FIG. 12, when drill bit 20 is moved axially forward at a rate of 625 ft/hr and rotated at a rate of 500 RPM (equivalent to a DOC in the axially forward direction of approximately 0.125 inches or approximately 0.25 inches per revolution), a location 95*a* on cutting edge 42 of cutting element 28 may have a positive clearance angle of 23.8°, a location 95*b* may have a positive clearance angle of 20.7°, a location 95*c* may have a positive clearance angle of 17.5°, and a location 95*d* may have a positive clearance angle of 11.4°.

In some examples, cutting elements may be sized and/or oriented so that a relatively small portion of each cutting element's cutting edge has a negative clearance angle. For example, cutting element 28 in FIG. 12 may be sized and oriented so that only a relatively small portion (in this example, no more than approximately 10%) of cutting edge 42 has a negative clearance angle. For example, as illustrated in FIG. 12, a location 95*e* on cutting edge 42 in relatively close proximity to central axis 48 may have a clearance angle of −10.2°, while each of locations 95*a*-95*d* may have positive clearance angles. In this example, a relatively small portion of side surface 46 of cutting element 28 in FIG. 12 may be exposed to a formation during drilling, thereby minimizing wear and damage to cutting element 28 and bit body 22. In some examples, the percentage of a cutting element's cutting edge having negative clearance angles may range from no more than approximately 5% to no more than approximately 20%.

In one example, cutting elements may also be sized and/or oriented so as to minimize the magnitude of any negative clearance angles along the cutting element's cutting edge. For example, cutting element 28 in FIG. 12 may be sized and oriented so that the clearance angles along cutting edge 42 do not exceed approximately −40°. In other examples, cutting elements may be sized and oriented so that the clearance angles along the cutting element's cutting edge do not exceed approximately −20°.

As detailed above, a variety of suitable ROPs, RPMs, and back-rake angles exist for the various embodiments described herein. For example, in an additional embodiment a cutting element 28 may be disposed on bit body 22 of drill bit 20 at a backrake angle of approximately 20°. In this example, when drill bit 20 is moved axially forward at a rate of 625 ft/hr and rotated at a rate of 500 RPM, locations on cutting edge 42 that correspond substantially to locations 95*a*-95*e* in FIG. 12 may have clearance angles of 18.4°, 15.6°, 12.7°, 7.2°, and −10.9°, respectively.

As detailed above, cutting elements may be sized and/or oriented so as to maximize the percentage of each cutting element's cutting edge that has a positive clearance angle. For example, as illustrated in FIG. 13, a cutting element 28 may be sized and/or oriented so that a substantial portion (represented by positive clearance angle region 97 in FIG. 13) of its cutting edge 42 may have a positive clearance angle. For example, positive clearance angle region 97 in FIG. 13 may comprise at least a majority of cutting edge 42. In at least one embodiment, positive clearance angle region 97 may comprise at least approximately 90% of cutting edge 42. In additional embodiments, positive clearance angle region 97 may comprise at least approximately 85% of cutting edge 42. In another embodiment, positive clearance angle region 97 may comprise at least approximately 80% of cutting edge 42.

Similarly, a relatively small portion of cutting edge 42 in FIG. 13 may have a negative clearance angle, as represented by negative clearance angle region 98. As described above, a side portion of cutting element 28 adjacent to negative clearance angle region 98 may contact a formation during drilling. In this example, a portion of side surface 46 that may contact a formation during drilling is represented by contact region 99.

As shown in FIG. 13, because cutting element 28 has a relatively small negative clearance angle region 98, contact region 99 may likewise comprise a relatively small portion of side surface 46, thereby minimizing wear and damage to cutting element 28 during drilling. Additionally, cutting elements 28 may be sized and/or oriented such that there is little or no contact between bit body 22 and a formation during drilling. Accordingly, at least a majority of side surface 46 may avoid contacting a formation during drilling. In various embodiments, at least approximately 75% of side surface 46 may avoid contacting a formation during drilling. In additional embodiments, at least approximately 85% of side surface 46 may avoid contacting a formation during drilling.

Figure 14:
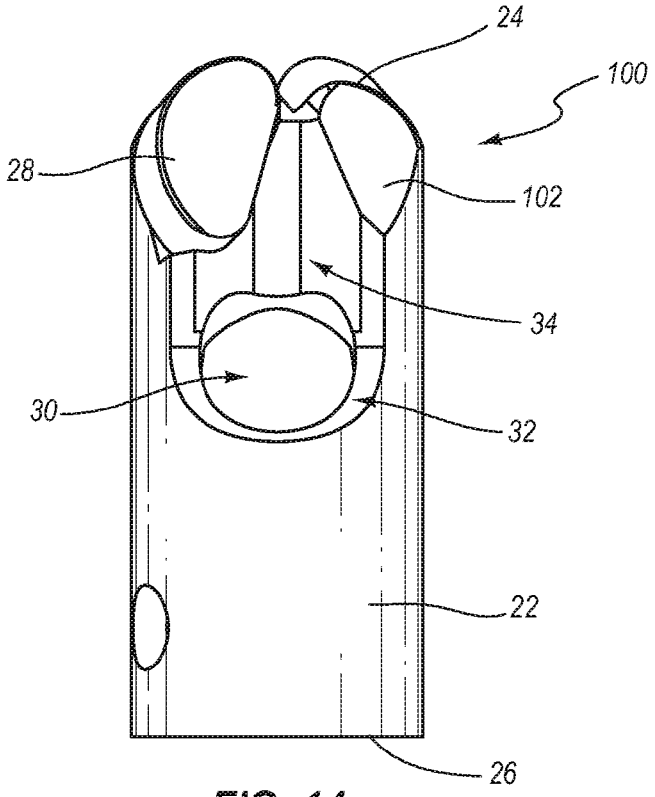
FIG. 14 is a side view of an exemplary drill bit according to an additional embodiment.
Figure 15:
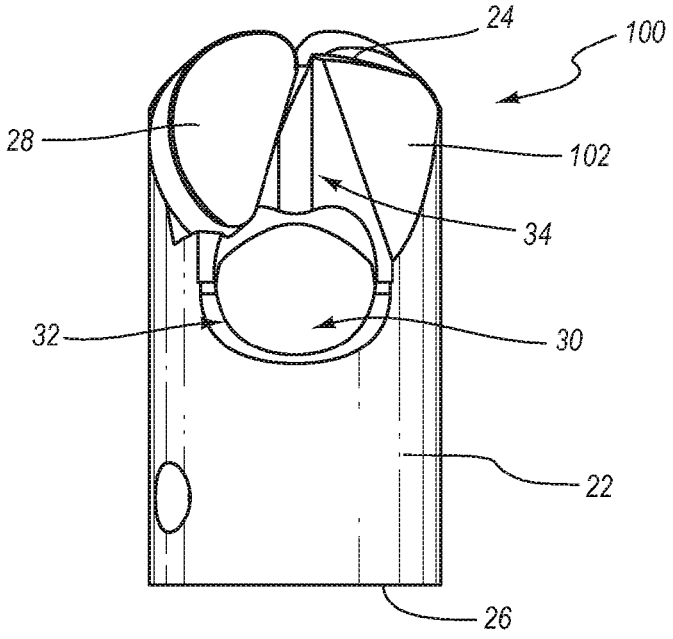
FIG. 15 is a side view of an exemplary drill bit according to an additional embodiment.

FIGS. 14 and 15 are side views of exemplary drill bits 100 according to additional embodiments. As illustrated in these figures, drill bits 100 may include a bit body 22 having at least one surface 102 that slopes between a forward end 24 and a side portion of bit body 22. Surface 102 may be adjacent debris channel 34 and opposite at least one of cutting elements 28. In some examples, surface 102 may facilitate channeling of debris from areas adjacent cutting elements 28 during drilling. Additionally, because surface 102 slopes radially inward relative to a side portion of bit body 22, a forward portion of bit body 22 exposed to a formation during drilling may be minimized.

Figure 16:
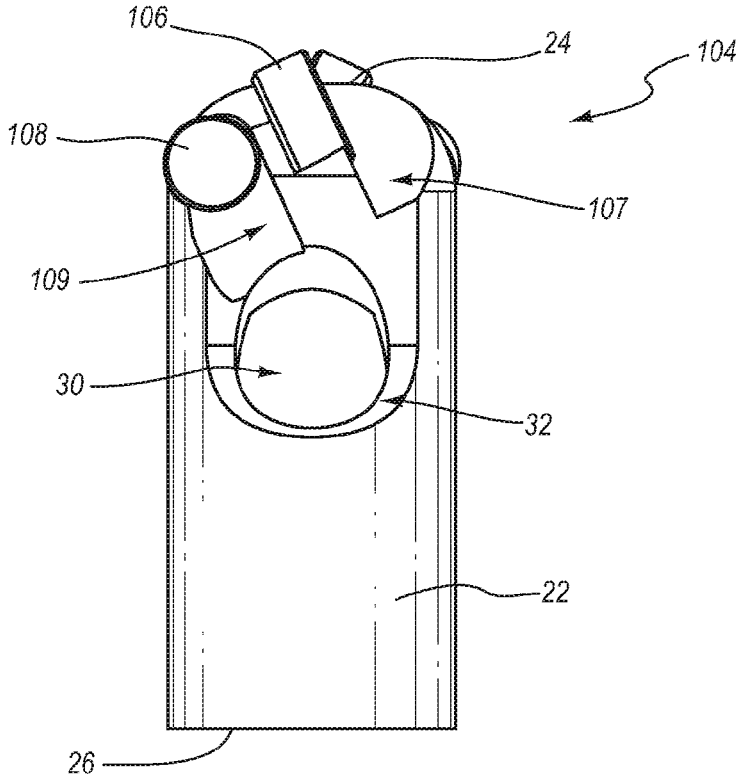
FIG. 16 is a side view of an exemplary drill bit according to an additional embodiment.
Figure 17:
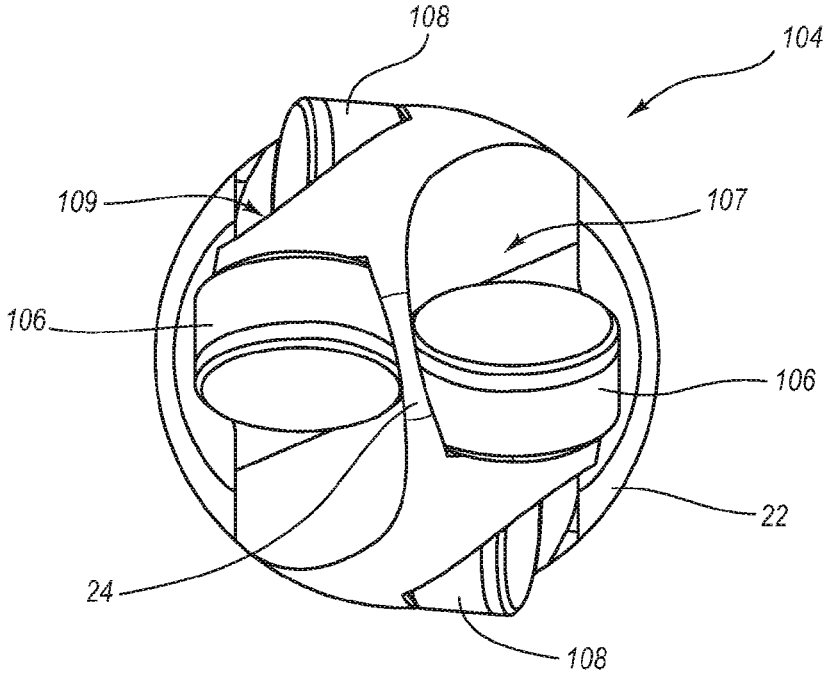
FIG. 17 is a top view of the exemplary drill bit illustrated in FIG. 16.

FIGS. 16 and 17 are side and top views, respectively, of an exemplary drill bit 104 according to an additional embodiment. As shown in these figures, at least four cutting elements may be coupled to bit body 22 of drill bit 104. For example, at least two cutting elements 106 may be coupled to a forward portion of bit body 22 such that cutting elements 106 extend from forward end 24. Additionally, at least two cutting elements 108 may be coupled to a radially outward portion of bit body 22 such that cutting elements 108 extend radially outward from bit body 22.

Figure 18:
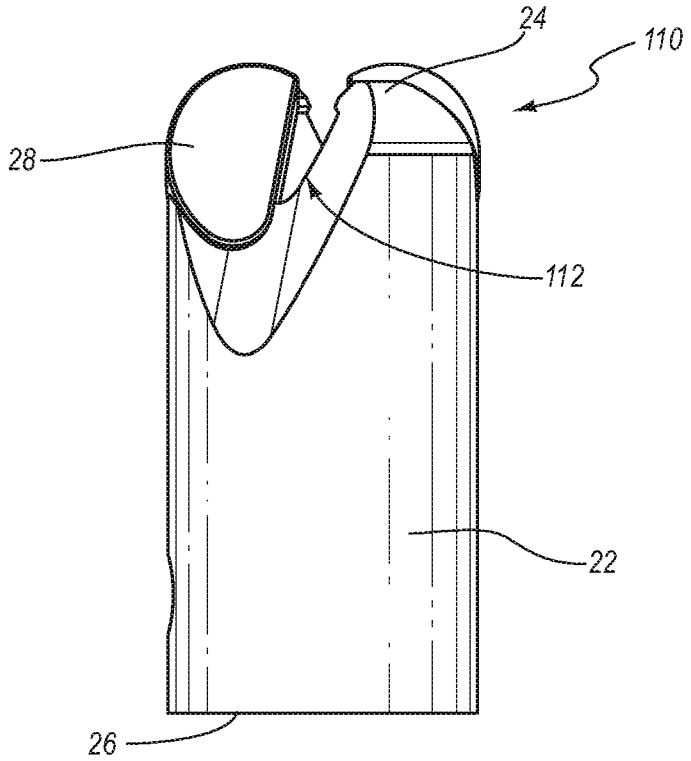
FIG. 18 is a side view of an exemplary drill bit according to an additional embodiment.
Figure 19:
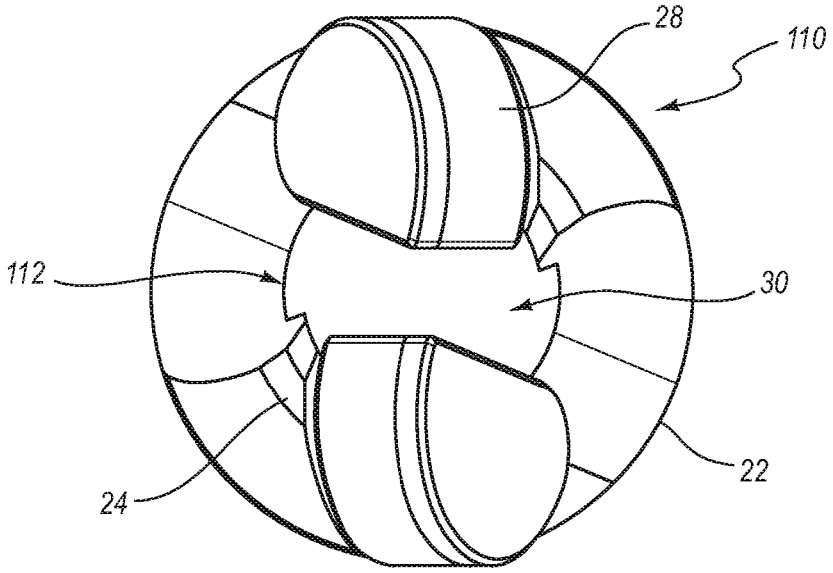
FIG. 19 is a top view of the exemplary drill bit illustrated in FIG. 18.

FIGS. 18 and 19 are side and top views, respectively, of an exemplary drill bit 110 according to an additional embodiment. As illustrated in this figure, a central opening 112 may be defined in bit body 22 of drill bit 110. In one embodiment, central opening 112 may be located between and/or partially defined by two or more cutting elements 28 coupled to bit body 22. During drilling, cutting debris may be conveyed from areas adjacent cutting elements 28 through central opening 112 and into a vacuum hole 30. Because central opening 112 is located in close proximity to cutting elements 28, a vacuum applied to vacuum hole 30 may effectively cool cutting elements 28 as air and debris are drawn over and around cutting elements 28. Additionally, central opening 112 may increase the structural integrity of bit body 22.

Figure 20:
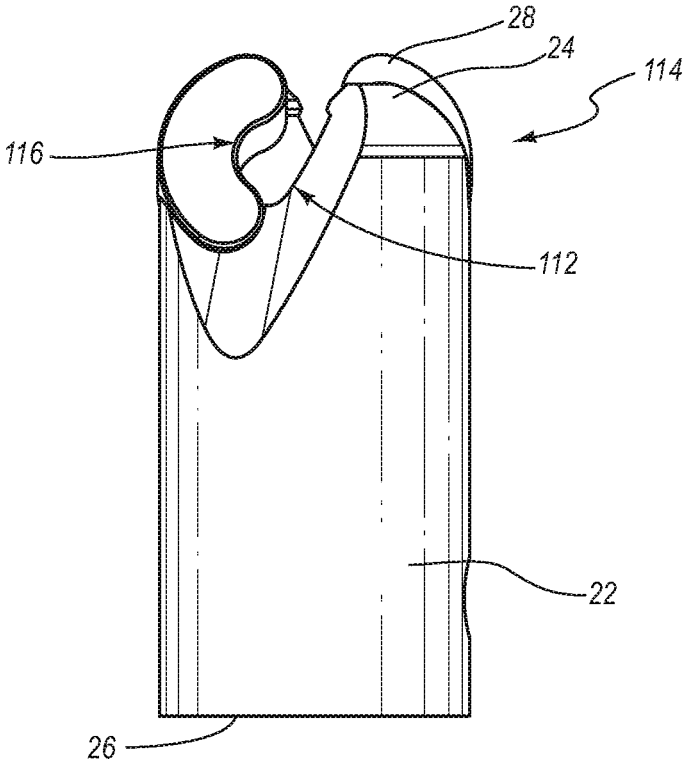
FIG. 20 is a side view of an exemplary drill bit according to an additional embodiment.

FIG. 20 is a side view of an exemplary drill bit 114 according to an additional embodiment. As shown in this figure, a concave portion 116 may be defined in at least one of cutting elements 28 at a position adjacent and open to a central opening 112. In this example, concave portion 116 may increase the area of central opening 112 that is open to a forward portion of drill bit 20, thereby facilitating removal of cutting debris from areas adjacent cutting elements 28 during drilling. Additionally, concave portion 116 may increase the area of cutting elements 28 bordering central opening 112, thereby facilitating cooling of cutting elements 28.

Figure 21:
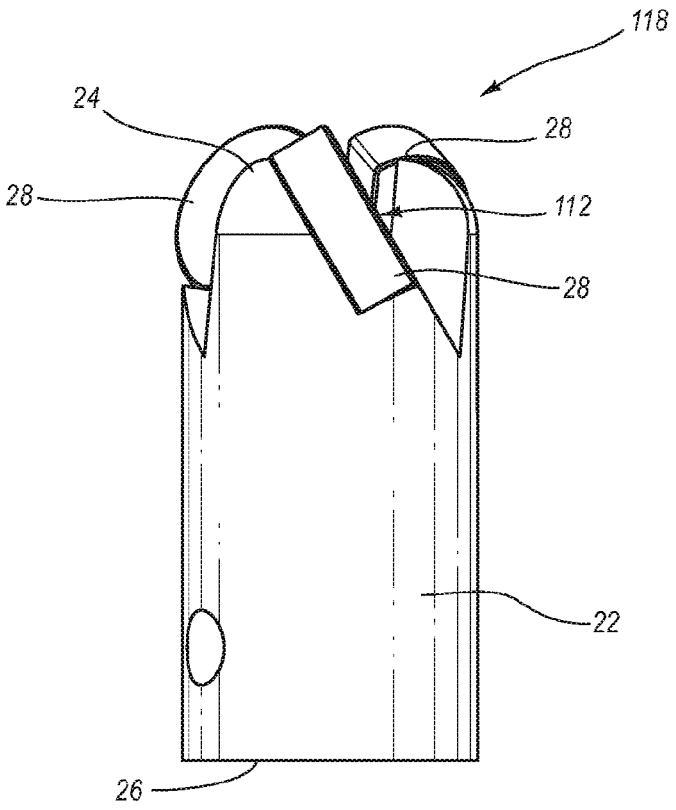
FIG. 21 is a side view of an exemplary drill bit according to an additional embodiment.
Figure 22:
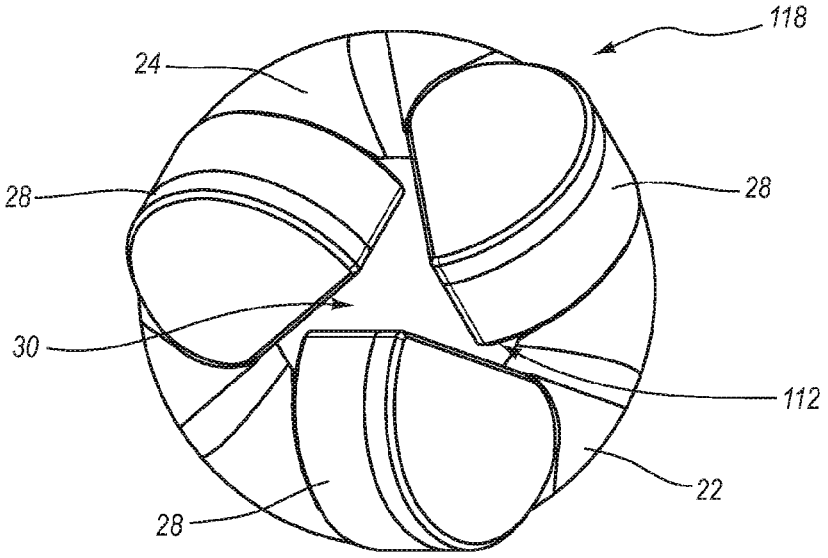
FIG. 22 is a top view of the exemplary drill bit illustrated in FIG. 21.
Figure 23:
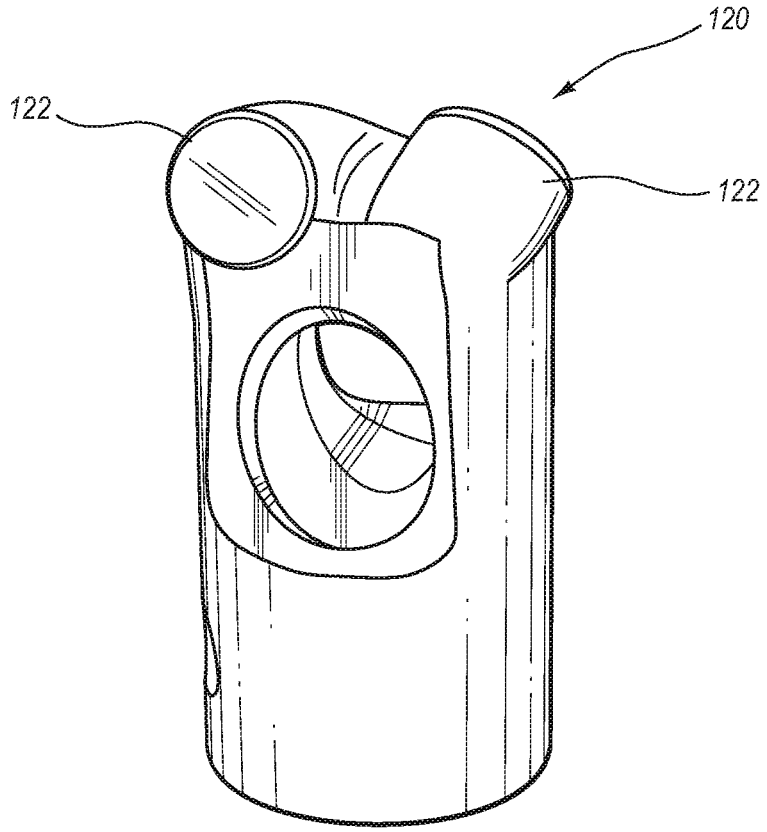
FIG. 23 (Prior Art)
FIG. 23 is a perspective view of a prior art drill bit.

FIGS. 21 and 22 are side and top views, respectively, of an exemplary drill bit 118 according to an additional embodiment. As shown in these figures, three or more cutting elements 28 may be coupled to a bit body 22 of drill bit 118. As described above, cutting elements 28 may be coupled to bit body 22 in any suitable configuration, without limitation. In certain embodiments, cutting elements 28 may be disposed adjacent to a central opening 112. As shown in FIG. 20, a significant portion of opening 112 may be defined by cutting elements 28.

The preceding description has been provided to enable others skilled the art to best utilize various aspects of the exemplary embodiments described herein. This exemplary description is not intended to be exhaustive or to be limited to any precise form disclosed. Many modifications and variations are possible without departing from the spirit and scope of the instant disclosure. It is desired that the embodiments described herein be considered in all respects illustrative and not restrictive and that reference be made to the appended claims and their equivalents for determining the scope of the instant disclosure.

Unless otherwise noted, the terms "a" or "an," as used in the specification and claims, are to be construed as meaning "at least one of." In addition, for ease of use, the words "including" and "having," as used in the specification and claims, are interchangeable with and have the same meaning as the word "comprising."

The invention claimed is:

1. A rotary drill bit, the rotary drill bit comprising:

a bit body rotatable about a central axis in a rotational direction, the bit body comprising a forward end and a rearward end;

a plurality of cutting elements coupled to the bit body, each of the plurality of cutting elements having a substantially planar, substantially semi-circular cutting face and each of the plurality of cutting elements comprising:

a substrate;

polycrystalline diamond bonded to the substrate;

a cutting edge adjacent the cutting face;

a back surface opposite the cutting face;

a side surface that extends in a direction substantially perpendicular to the cutting face;

a vacuum hole defined in the bit body, the vacuum hole configured to draw debris away from the plurality of cutting elements;

wherein:

the cutting edge of each of the plurality of cutting elements extends from adjacent the central axis to radially beyond an outer peripheral portion of the bit body;

a most axially forward point on each of the plurality of cutting elements is adjacent the central axis;

the cutting face of each of the plurality of cutting elements is oriented at a back-rake angle of between approximately 5° and approximately 45°;

each of the plurality of cutting elements is configured so that a majority of each side surface avoids contacting a formation during drilling;

in a top view, a most radially distant portion of the cutting edge of each of the plurality of cutting elements rotationally leads, in the rotational direction, a most axially forward portion of the cutting edge.

2. The rotary drill bit of claim 1, wherein each of the plurality of cutting elements is oriented so that at least approximately 75% of each side surface avoids contacting the formation during drilling.

3. The rotary drill bit of claim 1, wherein each of the plurality of cutting elements is oriented so that at least approximately 85% of each side surface avoids contacting the formation during drilling.

4. The rotary drill bit of claim 1, wherein the majority of each side surface avoids contacting the formation when the drill bit is moved in the axially forward direction at a rate of between approximately 120 ft/hr and approximately 850 ft/hr during drilling.

5. The rotary drill bit of claim 4, wherein the majority of each side surface avoids contacting the formation when the drill bit is rotated in the rotational direction about the central axis at a rate of between approximately 300 revolutions per minute and approximately 800 revolutions per minute.

6. The rotary drill bit of claim 1, wherein the plurality of cutting elements are circumferentially spaced substantially uniformly about the central axis.

7. The rotary drill bit of claim 6, wherein the plurality of cutting elements comprises two cutting elements positioned circumferentially substantially 180° apart.

8. The rotary drill bit of claim 1, wherein the side surface comprises:

an arcuate portion;

a substantially planar portion.

9. The rotary drill bit of claim 1, wherein the vacuum hole extends from an opening in the rearward end of the bit body to a side opening in the bit body.

10. The rotary drill bit of claim 9, wherein:

a portion of at least one of the plurality of cutting elements protrudes from the bit body;

the side opening is disposed axially rearward from the portion of the at least one of the plurality of cutting elements protruding from the bit body.

11. The rotary drill bit of claim 9, further comprising at least one concave debris channel defined in the bit body extending between the forward end of the bit body and the side opening.

12. The rotary drill bit of claim 1, further comprising at least one concave debris channel defined in the bit body extending along a portion of at least one of the plurality of cutting elements, the debris channel configured to guide debris to the vacuum hole.

13. The rotary drill bit of claim 1, wherein at least a portion of the polycrystalline diamond is at least partially leached.

14. The rotary drill bit of claim 1, wherein the cutting edge of each of the plurality of cutting elements slopes in an arcuate manner from a portion of the cutting edge adjacent the central axis to a portion of the cutting edge located more radially distant from the central axis than the outer peripheral portion of the bit body.

15. The rotary drill bit of claim 1, wherein the plurality of cutting elements are positioned adjacent the central axis such that the rotary drill bit does not generate a core in a borehole created by the rotary drill bit during drilling.

16. A drilling apparatus for drilling formations, the drilling apparatus comprising:

a drill rod;

a bit body coupled to the drill rod and rotatable in a rotational direction about a central axis, the bit body comprising a forward end and a rearward end;

a plurality of cutting elements coupled to the bit body, each of the plurality of cutting elements having a substantially planar, substantially semi-circular cutting face and each of the plurality of cutting elements comprising:

a substrate;

polycrystalline diamond bonded to the substrate;

a cutting edge adjacent the cutting face;

a back surface opposite the cutting face;

a side surface that extends in a direction substantially perpendicular to the cutting face;

a vacuum hole defined in the bit body, the vacuum hole configured to draw debris away from the plurality of cutting elements;

wherein:

the cutting edge of each of the plurality of cutting elements extends from adjacent the central axis to radially beyond an outer peripheral portion of the bit body;

a most axially forward point on each of the plurality of cutting elements is adjacent the central axis;

the cutting face of each of the plurality of cutting elements is oriented at a back-rake angle of between approximately 5° and approximately 45°;

each of the plurality of cutting elements is configured so that a majority of each side surface avoids contacting a formation during drilling;

in a top view, a most radially distant portion of the cutting edge of each of the plurality of cutting elements rotationally leads, in the rotational direction, a most axially forward portion of the cutting edge.

17. The rotary drill bit of claim 16, wherein each of the plurality of cutting elements is oriented so that at least approximately 75% of each side surface avoids contacting the formation during drilling.

18. The rotary drill bit of claim 16, wherein the plurality of cutting elements comprises two cutting elements positioned circumferentially substantially 180° apart.

19. The rotary drill bit of claim 16, wherein the side surface comprises:

an arcuate portion;

a substantially planar portion.

20. The rotary drill bit of claim 16, wherein the plurality of cutting elements are positioned adjacent the central axis such that the rotary drill bit does not generate a core in a borehole created by the rotary drill bit during drilling.

* * * * *